US012252336B2

(12) United States Patent
Yaremenko et al.

(10) Patent No.: US 12,252,336 B2
(45) Date of Patent: Mar. 18, 2025

(54) SURGE DAMPENING BAFFLE FOR FLEXIBLE LIQUID TRANSPORT TANKS

(71) Applicant: DonMark Holdings Inc., Delta (CA)

(72) Inventors: Victor Yaremenko, Delta (CA); Paul Reichard, Delta (CA); Jordan Donaldson, Delta (CA)

(73) Assignee: SEI Industries Ltd., Delta (CA)

( * ) Notice: Subject to any disclaimer, the term of this patent is extended or adjusted under 35 U.S.C. 154(b) by 35 days.

(21) Appl. No.: 18/112,960

(22) Filed: Feb. 22, 2023

(65) Prior Publication Data

US 2024/0278984 A1 Aug. 22, 2024

(51) Int. Cl.
*B65D 90/52* (2006.01)
*B65D 88/22* (2006.01)

(52) U.S. Cl.
CPC ..... *B65D 90/52* (2013.01); *B65D 88/22* (2013.01)

(58) Field of Classification Search
CPC ..... B65D 90/52; B65D 88/22
USPC ..... 209/187
See application file for complete search history.

(56) References Cited

U.S. PATENT DOCUMENTS

| | | | | |
|---|---|---|---|---|
| 2,024,908 A | | 12/1935 | Blum | |
| 2,355,084 A | * | 8/1944 | Kurrle | B64D 37/06 220/666 |
| 3,288,186 A | * | 11/1966 | Headrick | B64D 37/08 220/563 |
| 4,399,850 A | | 8/1983 | Schiemann | |
| 4,573,508 A | * | 3/1986 | Knaus | B65D 88/1656 220/666 |
| 5,368,395 A | | 11/1994 | Crimmins | |
| 5,403,095 A | | 4/1995 | Melk | |
| 5,499,743 A | * | 3/1996 | Blumenkron | B65D 88/1656 383/110 |
| 6,565,256 B2 | | 5/2003 | Derby et al. | |
| 10,029,848 B2 | * | 7/2018 | Yaremenko | B65D 90/52 |

FOREIGN PATENT DOCUMENTS

| | | |
|---|---|---|
| EP | 1657186 A1 | 5/2006 |
| WO | 03078277 A1 | 9/2003 |

* cited by examiner

*Primary Examiner* — Terrell H Matthews

(57) ABSTRACT

A baffle for a flexible liquid transport tank, having a base portion connected to an interior surface of the liquid transport tank, a single panel shaped to substantially cover the internal cross-sectional area defined by the liquid transport tank, and a link mechanism to interconnect the single panel to the base portion.

16 Claims, 7 Drawing Sheets

PRIOR ART

PRIOR ART

PRIOR ART

SURGE DAMPENING BAFFLE FOR FLEXIBLE LIQUID TRANSPORT TANKS

FIELD OF THE INVENTION

The present invention generally relates to a surge dampening baffle for flexible tanks used in transporting liquids.

BACKGROUND OF THE INVENTION

Flexible containers are used for the handling, storage and transportation of large volumes of liquids, such as water or fuel, to remote sites. These containers are commonly referred to as bladder or pillow tanks, and they are typically rectangular so that they can be efficiently loaded onto vehicles for transportation. Examples of some prior art flexible liquid containers are found in U.S. Pat. No. 4,573,508 to Knaus, U.S. Pat. No. 5,499,743 to Blumenkron, U.S. Pat. No. 3,288,186 to Headrick, and U.S. Pat. No. 10,029,848 to Yaremenko. Flexible liquid containers, such as exemplified in the aforementioned U.S. patents, are typically made of a flexible fiber reinforced elastomeric material and have inlets or nozzles for filling and draining purposes. A principal advantage to such flexible liquid containers is that they are relatively lightweight and compact when not filled with a liquid since they do not have a frame or rigid supports. Headrick and Yaremenko provides further advantages over Knaus and Blumenkron in that they disclose of surge attenuating baffles within the flexible liquid container. In particular, Yaremenko discloses of a flexible tank with a fabric and cable baffling system that dampens the wave or liquid current forces that are in effect during flight. The tank includes an inner tank and outer tank. The inner tank is provided with a plurality of internal transverse baffles, and each baffle is disposed in a plane that is substantially transverse to the principal direction of surge action of the liquid in the tank. Each baffle is composed from separate sections or flap portions, which have their base portions welded to the inside surface of the inner tank and their free end portions radiating inwardly towards the centre of the baffle. The free end portions of each flap portion can then be strung together with a cord or cable to form the baffle. The assembled baffles define a number of voids in between adjacent flap portions, and some ports are provided in some (or all) of the flap portions to allow a reduced flow of liquid between sections of the inner tank during filling and emptying of the inner tank. When fully assembled and filled with fluid, the transverse baffles provide a wave buffering system to counteract longitudinal acceleration of the fluid within the inner tank.

While the Yaremenko baffle system provides a wave buffering system to counteract longitudinal acceleration of the fluid, a more effective and simpler system would be beneficial. Accordingly, it is now recognized that there is a need for an improved baffle system that is simpler to manufacture and assemble.

SUMMARY OF THE INVENTION

In one aspect, the present invention provides a baffle for a liquid transport tank, comprising: a base portion connected to an interior surface of the liquid transport tank; a single panel shaped to substantially cover the internal cross-sectional area defined by the liquid transport tank; and a link mechanism to interconnect the single panel to the base portion.

In some aspects, the base portion is aligned along a line circumscribed by a plane transverse to a length of the liquid transport tank.

In some aspects, the base portion circumscribes a plane transverse to a length of the liquid transport tank.

In some aspects, the single panel further comprises a plurality of loops along the circumference of the single panel.

In some embodiments, the link mechanism comprises of: a plurality of loops on the single panel; a plurality of loops on the base portion; and a cord weaving through the plurality of loops on the single panel and the plurality of loops on the base portion.

In some aspects, the single panel further comprises of a foot portion connected to an interior surface of the liquid transport tank.

In some aspects, the foot portion further comprises of one or more apertures.

BRIEF DESCRIPTION OF THE DRAWINGS

Further features and advantages will be apparent from the following detailed description, given by way of example, of preferred embodiments taken in conjunction with the accompanying drawings, wherein.

DETAILED DESCRIPTION OF THE INVENTION

Figure 1:
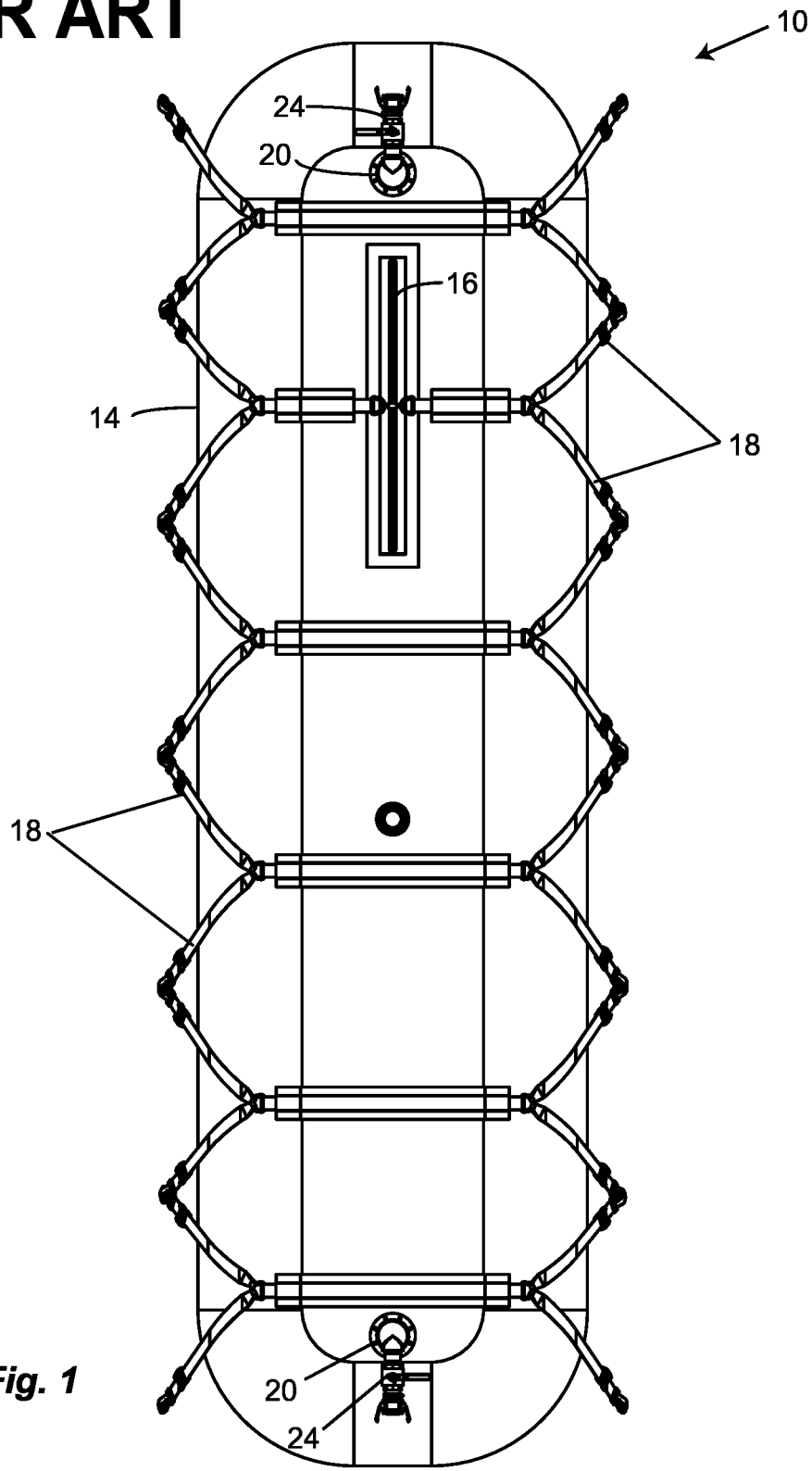
FIG. 1 is a top side view of a flexible transport tank of the PRIOR ART showing the outer tank.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention as defined by the claims.

Figure 2:
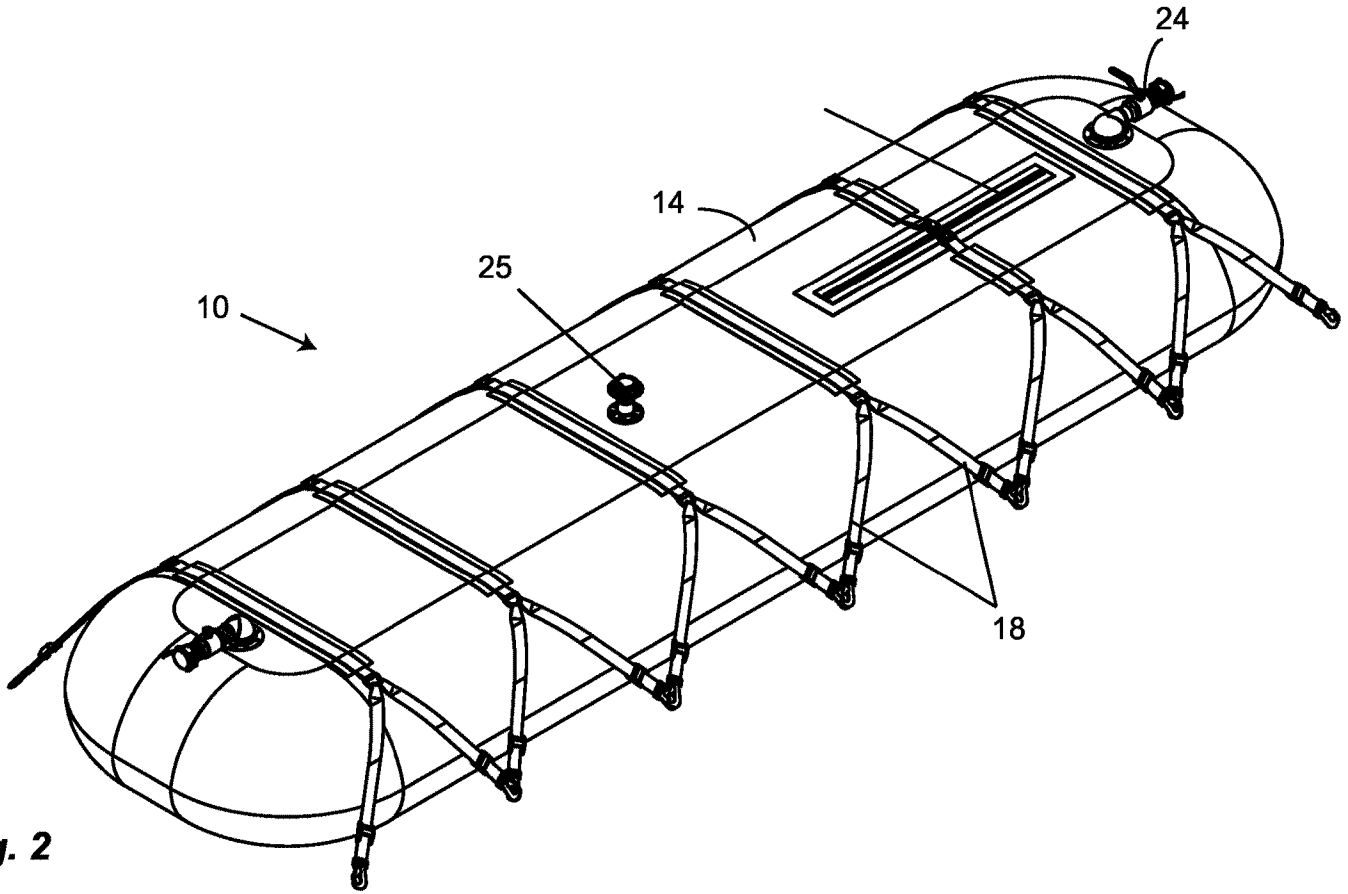
FIG. 2 is a perspective view of the outer tank of the flexible transport tank of the PRIOR ART in FIG. 1.
Figure 3:
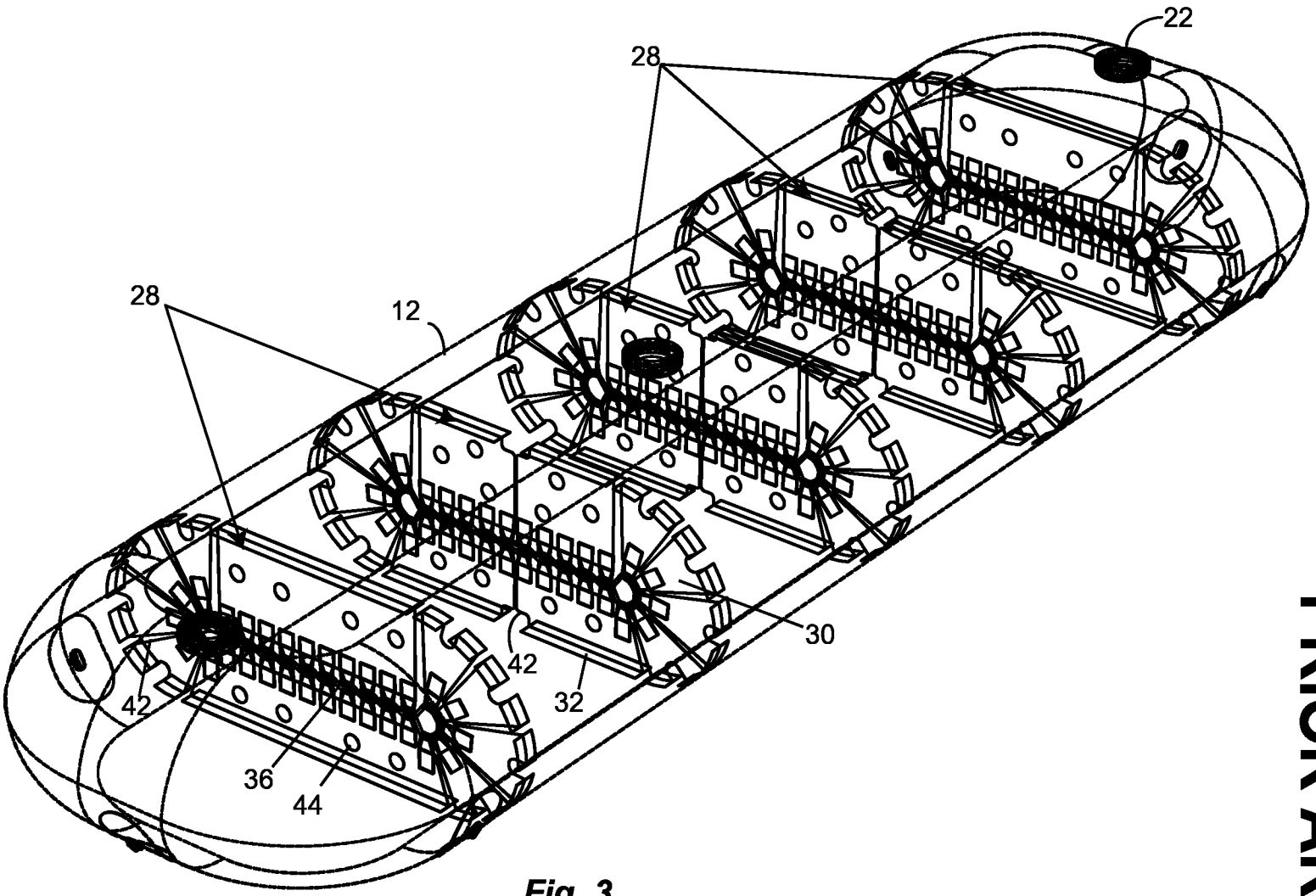
FIG. 3 is a perspective view from the top of the inner tank of the flexible liquid transport tank of the PRIOR ART in FIG. 1, with the walls of the inner tank shown translucent to reveal the structure of the baffles of the PRIOR ART within the inner tank.

Referring to FIG. 1 to FIG. 3, an embodiment of a flexible liquid transport tank of the prior art is shown generally by reference number 10. The flexible liquid transport tank illustrated is a double layered or "walled" design, comprising of an inner tank 12 that is removably received within an outer tank 14. The inner tank 12 is a flexible and collapsible bladder adapted to contain liquid, hence it is designed to be in constant contact with the liquid, which may be a hydrocarbon fuel. In embodiments intended for fuel applications, the inner tank 12 is made of material that is compatible for use with hydrocarbon fuels.

The outer tank 14 provides a flexible outer bladder that is adapted to removably receive the inner tank 12. The outer tank 14 is preferably highly abrasion and puncture resistant and, in embodiments intended for fuel applications, it is also chemically resistant to hydrocarbon fuel. A suitable material for the outer tank is an abrasion resistant urethane coated fabric, which is known and used in inflatable booms for the containment of oil spills. A liquid tight zipper 16 is provided on an access port on the outer tank 14 to enable the inner tank to be removed for inspection or replacement while providing a liquid tight seal of the access port. The location and/or the configuration of the zipper 16 may vary from one design of tank to another. The outer tank also may include a customizable webbing system 18 built in to enable the tank to be secured to the cargo floor of an aircraft or vehicle.

To provide for safe transport by aircraft, each flexible liquid transport tank may be designed for use with a particular aircraft or model of aircraft. As well, the tank should preferably be transported either completely full to minimize fluid dynamics, or empty.

Each tank has one or two dedicated fill and drain ports 20, 22 with valves 24 on the outer tank 14 to facilitate filling and discharging of liquid, and ball valves to seal the tank after filling is complete.

The inner tank 12 is provided with a plurality of internal transverse baffles 28, each baffle being disposed in a plane that is substantially transverse to the principal direction of surge action of the liquid (fuel) in the tank (i.e. substantially transverse to the length of the inner tank). Each baffle 28 includes of a plurality of flexible planar transverse panels such as flap portions 30 having a base portion 32 that is attached (welded) to the inside wall of inner tank 12. Each flap portion 30 has an unsupported portion or free end that includes a terminal end with a loop, and the free ends converge to be adjacent to the loops of neighboring flap portions in the assembled inner tank. A cord of cable 36 is laced through the loops in a weave pattern to draw the loops together and thereby draw flap portions 30 taut to provide structural rigidity to baffle 28. The assembled baffles 28 define a number of voids 42 in between adjacent flap portions, and some ports 44 are provided in some (or all) of the flap portions to allow a reduced flow of liquid between sections of the inner tank 12 during filling and emptying of the inner tank 12. With inner tank 12 filled, transverse baffles 28 provide a wave buffering system to counteract longitudinal acceleration of the fluid within inner tank 12.

Figure 4:
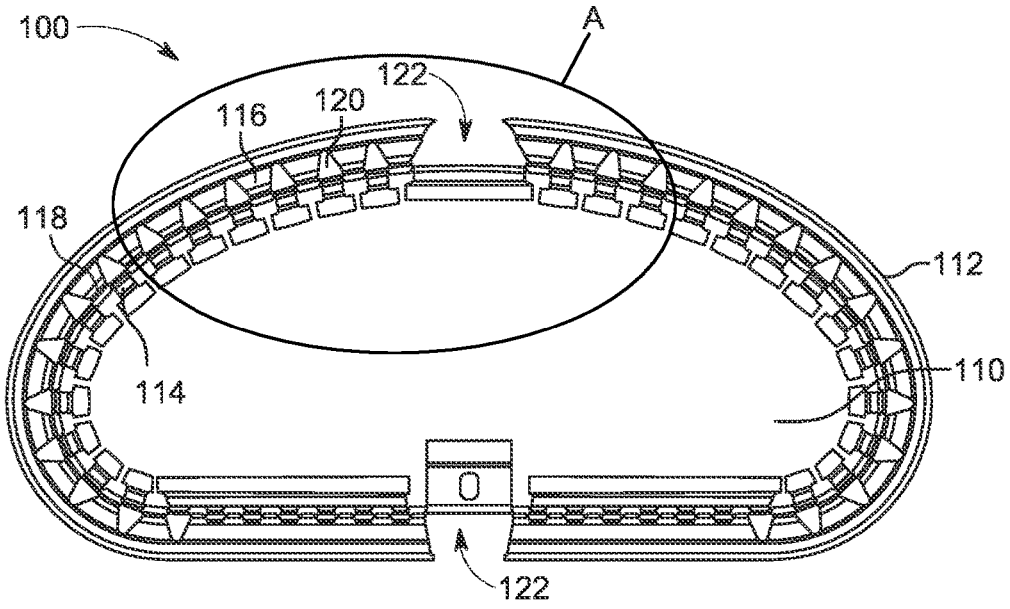
FIG. 4 is a view of a baffle in accordance with an embodiment of the present invention.
Figure 4A:
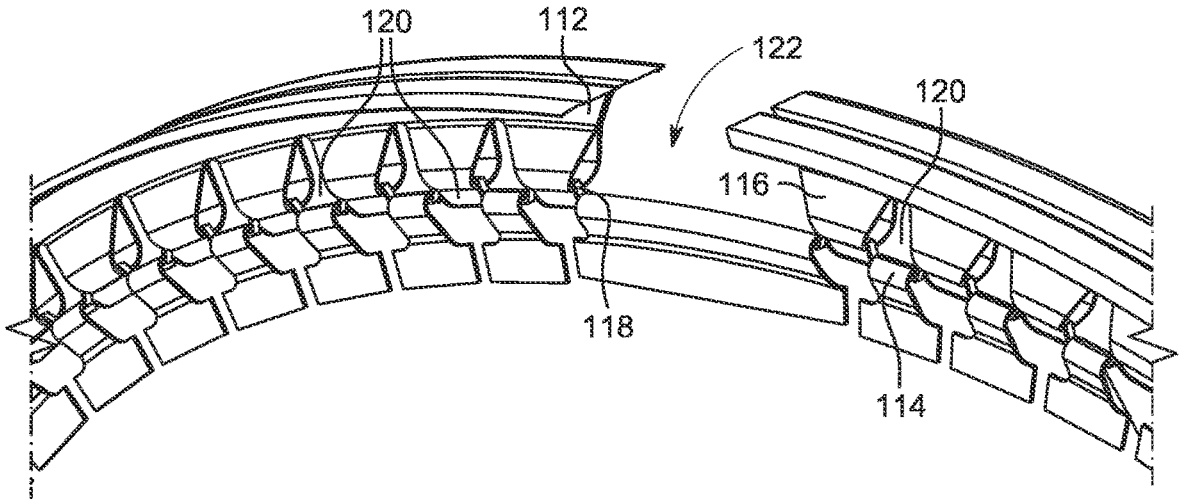
FIG. 4*a* is a close-up view of a portion "A" of the baffle of FIG. 4.
Figure 5:
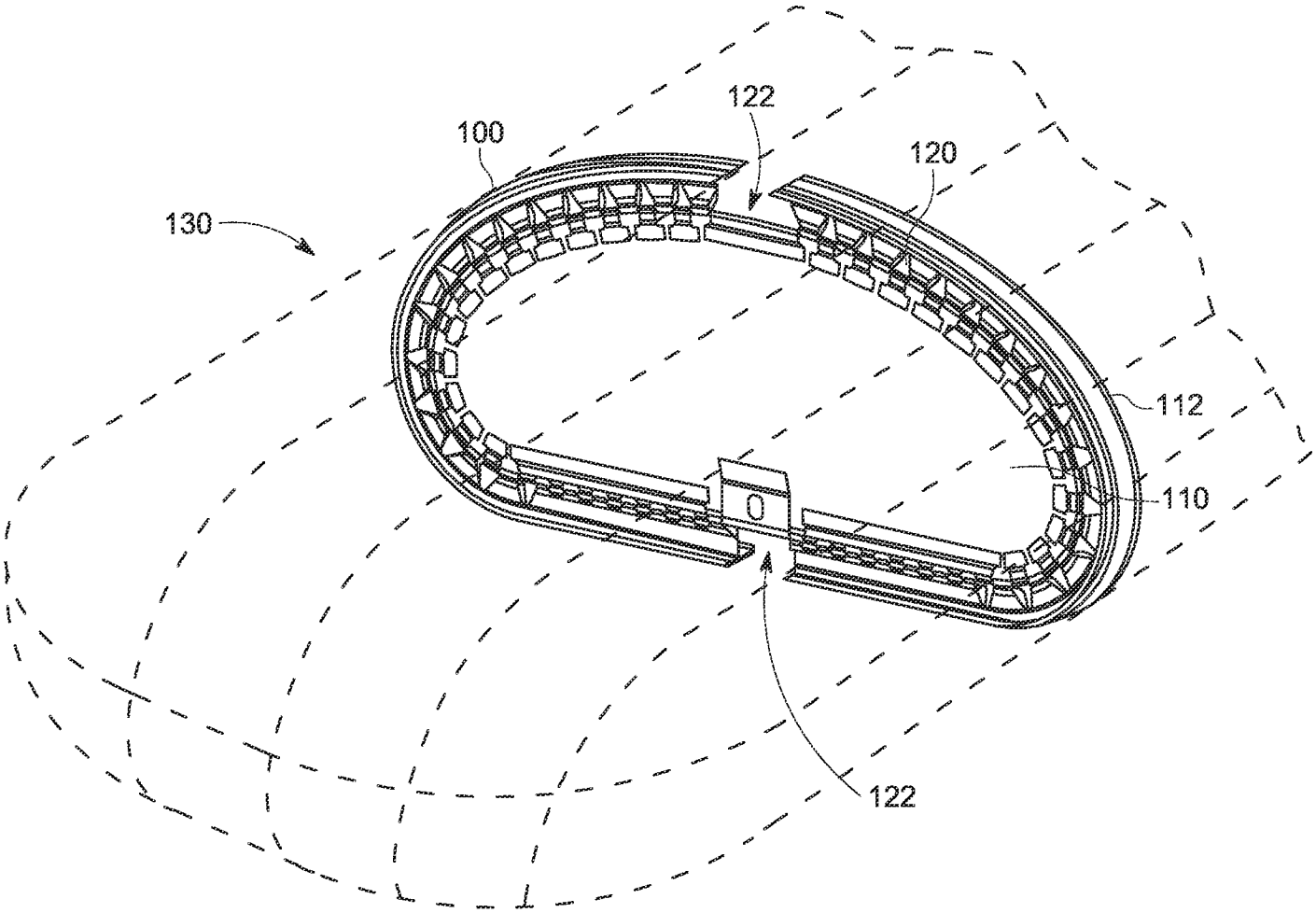
FIG. 5 is a view of a baffle of FIG. 4 shown in the environment of an inner tank of a flexible transport tank.

The improvement is a tank baffle system of the present invention. Referring to FIG. 4 and FIG. 5, an inner tank 130 is provided with a plurality of internal transverse baffles 100, each baffle being disposed in a plane that is substantially transverse to the principal direction of surge action of the liquid (fuel) in the tank (i.e., substantially transverse to the length of the inner tank 130). The inner tank 130 may be similar in construction to inner tank 12 of the prior art. It is to be understood by a person skilled in the art that baffles 100 may also be used in single tank systems, where the outer tank may be omitted. Each baffle 100 is composed of a single panel 110 and a circumferential base portion 112 that is attached (welded) to the inside wall of the inner tank and aligned along a line circumscribed by a plane transverse to a length of the inner tank 130, hence in line with the plane of the baffle 100. Referring to FIG. 4, each single panel 110 has a plurality of loops 114 along its circumference. Each panel 110 is substantially in the same shape as a cross-section segment of inner tank 130, taken on a plane that is transverse to the length of inner tank 130. Each base portion 112 includes a plurality of loops 116 arranged around the circumference of the inside wall of the inner tank 130 and projecting inwardly towards a central longitudinal axis of the inner tank 130. A cord or cable 118 is laced through loops 114 and loops 116 to draw loops 114 and loops 116 together and thereby form an assembled baffle 100. Loops 114 and loops 116 together with cable 118 provide an example of a link mechanism that interconnect panel 110 with base portion 112 to provide a barrier to fluid flow across the internal baffle when inner tank 130 is filled with fluid. However, it will be understood by a person skilled in the art that other suitable link mechanisms may be used. For example, instead of threading a cord or cable through a series of loops, loops, snaps, buckles, clips or hooks that individually connect to each other via may be used.

To assemble baffle 100, a person climbs inside inner tank 130 via an encapsulated access hole, which is sealed in the finished product, and performs the final assembly of baffles 100 by lacing panels 110 to base portion 112 through loops 114 and loops 116, using one cord/cable 118 per baffle 100. Alternatively, the above process may be carried out earlier in the manufacturing process prior to sealing existing panel seams and openings. In such instances, there would be no need for a purpose-made encapsulated access hole.

The assembled baffles 100 define a number of gaps 120 located between each of individual loops 114 and loops 116, and some ports 122 are provided in base portion 112 to allow a reduced flow of liquid between sections of inner tank 130. In the illustrated embodiment, the transverse panels 110 are shaped in a manner that enables the transverse baffle 100 to substantially cover most of the internal cross sectional area defined by inner tank 130 with liquid therein such that adjacent internal transverse baffles 100 define a substantially compartmentalized space in between said adjacent transverse baffles 100.

With inner tank 130 filled, the transverse baffles 100 provide a wave buffering system to counteract longitudinal acceleration of the fluid within inner tank 130. As a result, baffles 100 prevent the center of gravity of the tank from shifting, which is very important for aircraft controllability.

Figure 6:
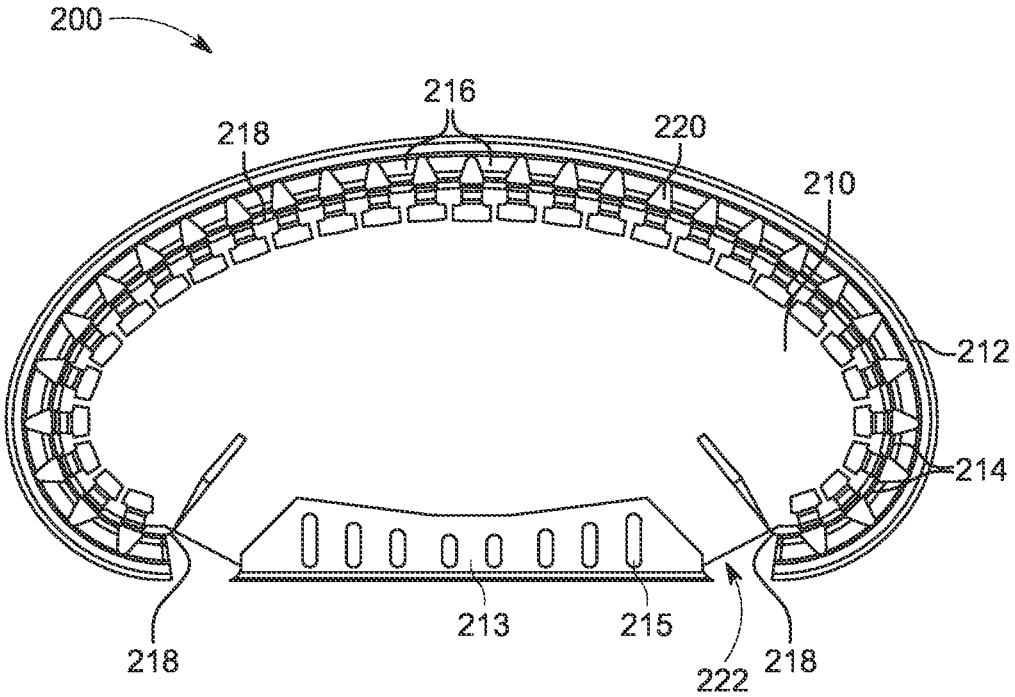
FIG. 6 is a view of another embodiment of the baffle of the present invention.
Figure 7:
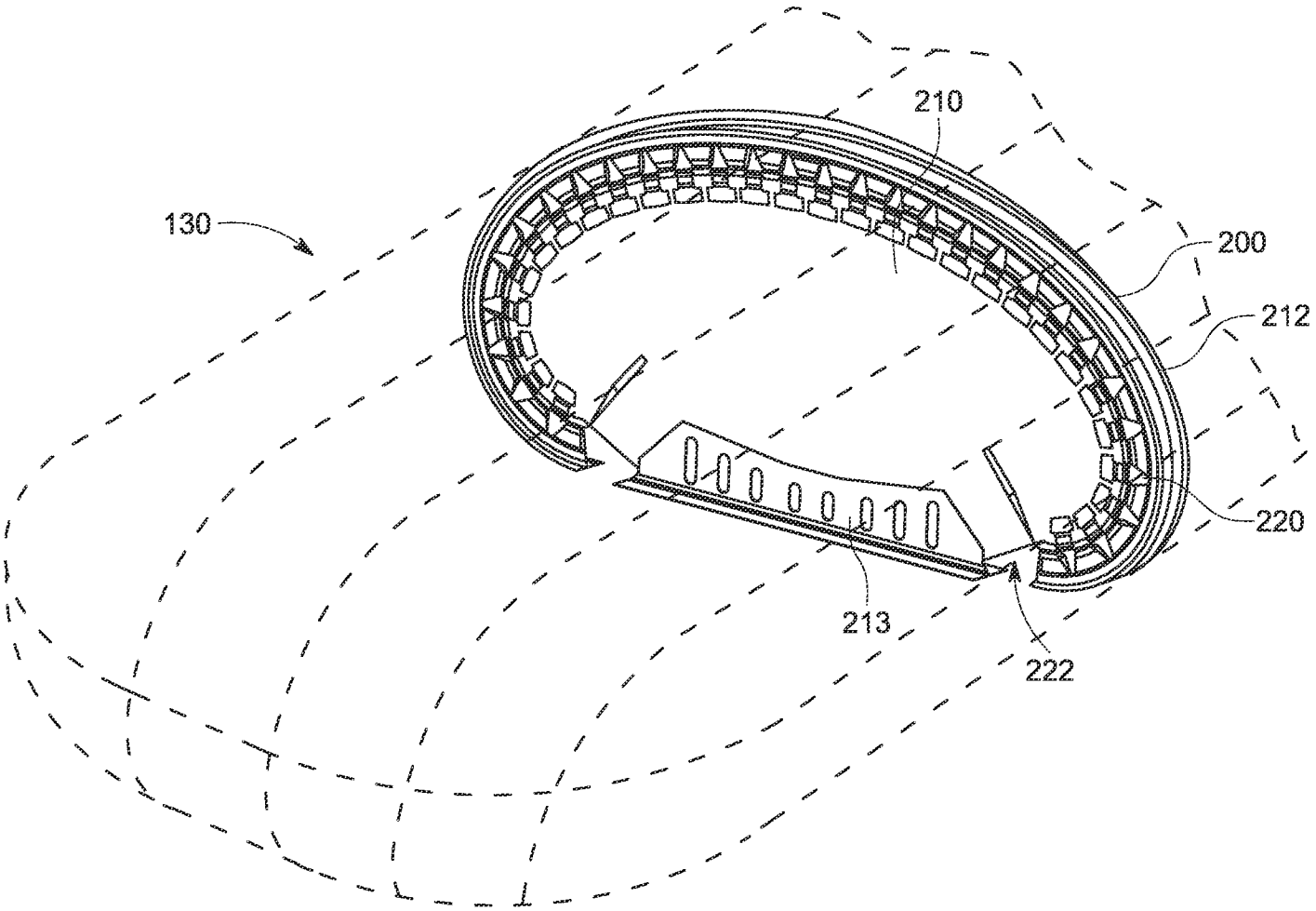
FIG. 7 is a view of a baffle of FIG. 6 shown in the environment of the inner tank of a flexible transport tank.

Referring to FIG. 6 and FIG. 7, another embodiment of the present invention is shown. Each baffle 200 is composed of a single panel 210 and a semi-circumferential base portion 212 that is attached (welded) to the inside wall of the inner tank 130 and aligned along a line circumscribed by a plane transverse to a length of the inner tank 130, hence in line with the plane of the baffle 200. It is to be understood by a person skilled in the art that baffles 200 may also be used in single tank systems, where the outer tank may be omitted. Each single panel 210 includes a plurality of loops 214 along a portion of its circumference and a foot portion 213. Each panel 210 is substantially in the same shape as a cross-section segment of inner tank 130, taken on a plane that is transverse to the length of inner tank 130. Foot portion 213 includes one or more apertures 215. Foot portion 213 is attached (welded) to the inside wall of inner tank 130. Each base portion 212 includes a plurality of loops 216 arranged around the circumference of the inside wall projecting inwardly towards the central longitudinal axis of inner tank 130. A cord or cable 218 is welded to panel 210 on each side of panel 210 near foot portion 213. Cord or cable 218 is laced through loops 214 and loops 216, meeting at the top middle of panel 210 with a link. Once cord or cable 218 is linked together, loops 214 and loops 216 are drawn together to form an assembled baffle 200. Loops 214 and loops 216 together with cable 218 provide an example of a link mechanism that interconnect panel 210 with base portion 212 to provide a barrier to fluid flow across the internal baffle when inner tank 130 is filled with fluid. However, it will be understood by a person skilled in the art that other suitable link mechanisms may be used. For example, instead of threading one or more cords or cables through a series of loops, loops, snaps, buckles, clips or hooks that individually connect to each other via may be used.

To assemble baffle 200, a person climbs inside inner tank 130 via an encapsulated access hole, which is sealed in the finished product, and performs the final assembly of baffles 200 by lacing panels 210 to base portions 212 through loops 214 and loops 216, using cord/cable 218. Alternatively, the above process may be carried out earlier in the manufacturing process prior to sealing existing panel seams and openings. In such instances, there would be no need for a purpose-made encapsulated access hole.

The assembled baffles 200 define a number of gaps 220 located between each of individual loops 214 and loops 216, and some ports 222 are provided in between base portion 212 and panel 210 to allow a reduced flow of liquid between sections of inner tank 130. In the illustrated embodiment, the transverse panels 210 are shaped in a manner that enables the transverse baffle 200 to substantially cover most of the internal cross sectional area defined by inner tank 130 with liquid therein such that adjacent internal transverse baffles 200 define a substantially compartmentalized space in between said adjacent transverse baffles 200.

The number, placement and configuration of the gaps 120, 220, the ports 122, 222, and the apertures 215 may be varied as desired or as required for a particular application of the present invention.

The baffles of the present invention have a contour that matches the shape of a cross-section segment of a conventional liquid transport tank/bladder. This particular shape of the baffles of the present invention is advantageous in that it allows for smooth linkage of the base portions of the baffles to the curved interior surface of the liquid transport tanks as well as the panels to the base portions. The proposed baffle design allows more smooth linkage of the baffle to the curved bladder surface as loops attached to the base portions and thereby to the bladder have shorter straight bases. As a result, the load from a bladder being passed to a baffle is distributed more evenly along the baffle panel and bladder. Further, the panels' solid surface (with little to no gaps) provides more efficient dampening of liquid movement between baffles. The baffles of the present invention have better production workability and are also easier to manufacture and assemble.

Other aspects and features of the present invention will become apparent to those of ordinary skill in the art upon review of the following description of specific embodiments of the invention in conjunction with the accompanying figures.

While the above description and illustrations constitute preferred or alternate embodiments of the present invention, it will be appreciated that numerous variations may be made without departing from the scope of the invention. It is intended that the invention be construed as including all such modifications and alterations.

What is claimed is:

1. A baffle for a flexible liquid transport tank, comprising:
- a base portion connected to an interior surface of the liquid transport tank;
- a single panel shaped to substantially cover the internal cross-sectional area defined by the liquid transport tank; and
- a link mechanism to removably interconnect the single panel to the base portion.

2. The baffle of claim 1, wherein the base portion is aligned along a line circumscribed by a plane transverse to a length of the liquid transport tank.

3. The baffle of claim 1, wherein the base portion circumscribes a plane transverse to a length of the liquid transport tank.

4. The baffle of claim 1, wherein the base portion further comprises of a plurality of loops.

5. The baffle of claim 1, wherein the single panel further comprises a plurality of loops along the circumference of the single panel.

6. The baffle of claim 1, wherein the link mechanism comprises of:
- a plurality of loops on the single panel;
- a plurality of loops on the base portion; and
- a cord weaving through the plurality of loops on the single panel and the plurality of loops on the base portion.

7. The baffle of claim 1, wherein the single panel further comprises of a foot portion connected to an interior surface of the liquid transport tank.

8. The baffle of claim 7, wherein the foot portion further comprises of one or more apertures.

9. A flexible liquid transport tank comprising one or more baffles as claimed in claim 1.

10. A flexible liquid transport tank comprising one or more baffles as claimed in claim 2.

11. A flexible liquid transport tank comprising one or more baffles as claimed in claim 3.

12. A flexible liquid transport tank comprising one or more baffles as claimed in claim 4.

13. A flexible liquid transport tank comprising one or more baffles as claimed in claim 5.

14. A flexible liquid transport tank comprising one or more baffles as claimed in claim 6.

15. A flexible liquid transport tank comprising one or more baffles as claimed in claim 7.

16. A flexible liquid transport tank comprising one or more baffles as claimed in claim 8.

* * * * *